US005441432A

United States Patent [19]

Rodskier et al.

[11] Patent Number: 5,441,432

[45] Date of Patent: Aug. 15, 1995

[54] BOAT PROPELLER DRIVE UNIT

[75] Inventors: Christian Rodskier, Torslanda; Lennart Sellman, Onsala, both of Sweden

[73] Assignee: AB Volvo Penta, Gothenburg, Sweden

[21] Appl. No.: 146,156

[22] PCT Filed: May 15, 1992

[86] PCT No.: PCT/SE92/00319

§ 371 Date: Jan. 13, 1994

§ 102(e) Date: Jan. 13, 1994

[87] PCT Pub. No.: WO92/20574

PCT Pub. Date: Nov. 26, 1992

[30] Foreign Application Priority Data

May 15, 1991 [SE] Sweden ..... 9101466

[51] Int. Cl.[6] ..... B63H 21/32

[52] U.S. Cl. ..... 440/89

[58] Field of Search ..... 440/89, 900, 78, 79, 440/80; 60/310; 181/235

[56] References Cited

U.S. PATENT DOCUMENTS

| | | | |
|---|---|---|---|
| 2,111,325 | 3/1938 | Linthwaite | 440/89 |
| 4,600,394 | 7/1986 | Dritz | 440/89 |
| 4,840,136 | 6/1989 | Brandt | 440/78 |
| 4,871,334 | 10/1989 | Mc Cormick | 440/89 |
| 4,891,025 | 1/1990 | Brandt | 440/89 |

FOREIGN PATENT DOCUMENTS

| | | | |
|---|---|---|---|
| 0238192 | 10/1987 | Japan | 440/89 |
| 392698 | 4/1977 | Sweden . | |
| 457164 | 12/1988 | Sweden . | |

*Primary Examiner*—Edwin L. Swinehart
*Attorney, Agent, or Firm*—Young & Thompson

[57] ABSTRACT

An outboard boat propeller drive unit with an anti-cavitation plate (6) above the propeller or propellers (4,5) has an exhaust duct (7) extending through the anti-cavitation plate. The exhaust duct (7) has its outlet port (11) located on the underside of the anti-cavitation plate level with and just above the sweep "a" of the blade tips of the aft propeller.

9 Claims, 2 Drawing Sheets

BOAT PROPELLER DRIVE UNIT

FIELD OF THE INVENTION

The present invention relates to a boat propeller drive unit comprising a gear housing, in which at least one propeller shaft with a propeller is rotatably mounted, and an anti-cavitation plate which extends out over the propeller from the gear housing, has a distal end located aft of the sweep of the tips of the propeller blades and contains an exhaust duct with an outlet port for exhaust from an engine coupled to the drive unit.

BACKGROUND OF THE INVENTION

In a known common boat propeller drive unit of this type, a so-called inboard-outboard drive, in which the exhaust is conducted through a duct in the anti-cavitation plate, the distal end of the anti-cavitation plate is open aft and forms a rearwardly directed exhaust ejector. When operating planing motorboats equipped with such drive units at planing speed,, the exhaust is ejected directly out into the atmosphere, which has the advantage of low exhaust counter-pressure. In boats with vertical transoms with a relatively large surface and large superstructures, back-suction can occur however at certain speeds, with the result: that a cloud of exhaust will remain behind the transom and accompany the boat. In boats with the cockpit aft, exhaust can even be sucked into the cockpit creating discomfort to the passengers. Another common method of conducting exhaust away from a motorboat with an inboard-outboard drive unit is to allow the exhaust to exit through an exhaust duct in the propeller hub. The exhaust is thus ejected into the water even at planing speeds and the risk of exhaust being sucked into the cockpit due to back-suction is eliminated. Exhaust ejection through the propeller hub below the surface of the water creates however a higher exhaust counter-pressure than ejection through the cavitation plate directly out into the atmosphere.

SUMMARY OF THE INVENTION

The purpose of the present invention is to provide a propeller drive unit with an exhaust duct into the anti-cavitation plate which, while retaining a low exhaust counter-pressure, eliminate the risk of exhaust being sucked into the boat cockpit due to back-suction.

This is achieved according to the invention by virtue of the fact that the outlet port of the exhaust duct opens on the underside of the cavitation plate and is directed towards and is spaced from the distal end of the cavitation plate, said spacing being at least equal to the distance from said end to the sweep of the tips of the propeller blades.

It has been determined quite surprisingly that by moving the exhaust port slightly downwards and forwards as compared to the known design, together with the arrangement of a relatively short "screen" behind and above the port, it is possible to completely eliminate the risk of exhaust due to back-suction, being sucked into the cockpit and with no increase in the exhaust counter-pressure.

According to a preferred embodiment of the propeller drive unit according to the invention, the exhaust duct is defined by an arched hood which extends over the major portion of the length of the anti-cavitation plate and is sloped in the direction from the gear housing relative to the surrounding planar surface portions of the underside of the anti-cavitation plate and has, in horizontal projection, an essentially triangular shape with the tip of the triangle directed towards the gear housing. Such an embodiment results in the least possible deflection of the exhaust and eliminates the risk that the water flowing past the unit will exert an undesirable lifting force on the drive unit via the anti-cavitation plate.

BRIEF DESCRIPTION OF THE DRAWINGS

The invention will be described below in more detail with reference to an example shown in the accompanying drawings, where.

DETAILED DESCRIPTION OF THE INVENTION

Figure 1:
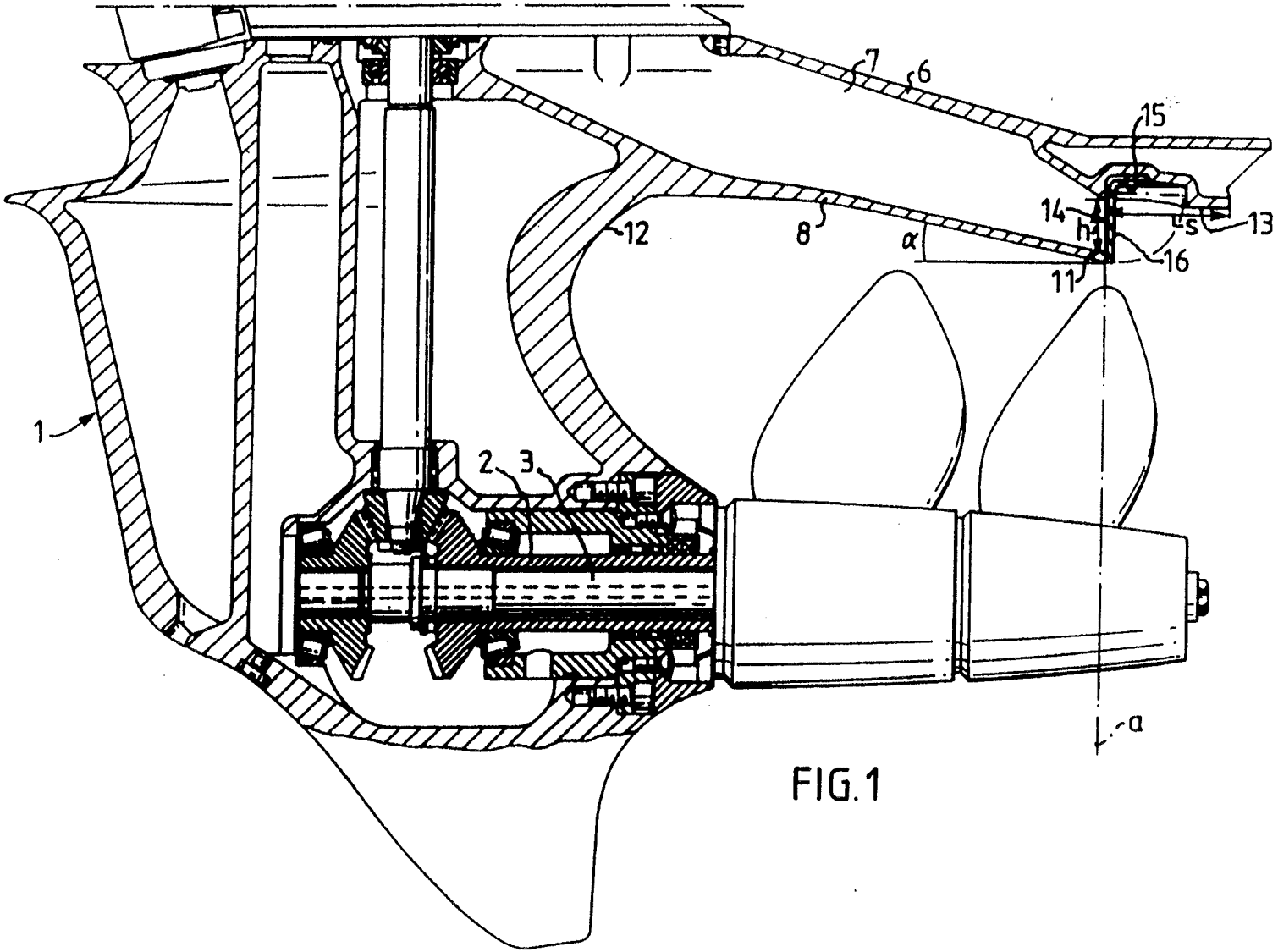
FIG. 1 shows a longitudinal section through the lower gear housing of a propeller drive unit according to the invention.
Figure 2:
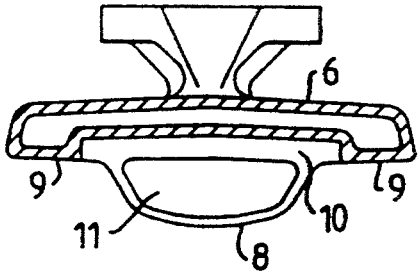
FIG. 2 shows a cross section along the line II—II in FIG. 1

In FIG. 1, 1 designates the lower gear housing of a steerable outboard drive unit, which as regards as general design can be of the type shown and described in SE-A-8504310. In the gear housing 1, a pair of propeller shafts 2 and 3 are concentrically mounted, such shafts each supporting a propeller 4, 5 respectively. Above the propellers, the gear housing 1 is designed in a conventional manner with a cavitation plate 6 extending aft over the propellers and terminating slightly aft of the aft propeller 5. The anti-cavitation plate 6 defines an exhaust duct 7.

The gear housing 1 shown differs from the gear housings of the previously known drive units of the type in question, e.g. the drive unit in SE-A-8504310, by modified design of the cavitation plate 6. The exhaust duct 7 is thus lower relative to the known design, the plate 6 being extended downwards on its underside so that it forms an arched hood 8 defining the lower half of the exhaust duct and being surrounded by planar surface portions 9 on the underside of the plate. The hood 8 terminates at plane "a" where the blade tips of the aft propeller 5 sweep and defines together with the surrounding portions of the plate 6 an exhaust duct 11.

Figure 3:
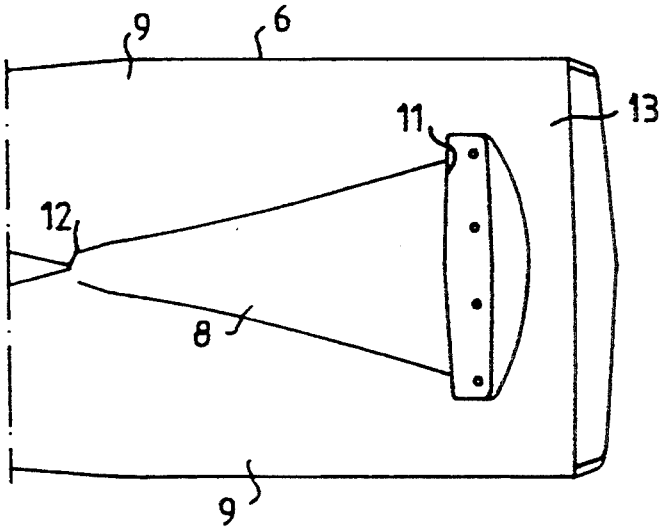
FIG. 3 is a view from below of the anti-cavitation plate.

The hood 8 starts at the aft edge 12 of the gear housing 1 and extends aft to the plane "a" with a slope which can vary between about 10° and 15° relative to the surface portions 9 of the anti-cavitation plate and in the example shown in FIG. 1 its rear portion is inclined at an angle $\alpha$of 12° to the surface portion 9. The hood 8 has a triangular profile in horizontal projection as indicated by FIG. 3. The shape described of the hood 8 means that the exhaust counter-pressure will not be affected and that the anti-cavitation plate will not be acted on by a lifting force from the flowing water other than what is normal for the previously known designs with exhaust ports at the aft end of anti-cavitation plate. The shape and placement of the outlet port 11 means that the exhaust will be conducted to the surface water and be carried away with the propeller wash without affecting the propelling force of the propellers since the exhaust flow lies completely outside the flow cylinder of the propellers.

The anti-cavitation plate wall portion 13 lying aft and just above the port 11 has in the example shown in FIG.

1 a longitudinal dimension "s" which is somewhat more than twice the height "h" of the exhaust port 11. In practice this function has a "screen portion" of about 40–50 mm.

In order to prevent water from being forced in through the exhaust port 11 when the boat is stationary with the engine turned off, a checkvalve device is arranged in the form of a pair of rubber flaps 14 placed side by side to seal the port 11. The flaps 14 have an L-shape and are fixed in a depression 15 so arranged in the wall portion 13 that that portion 16 of the flap which closes the port 11 is pressed into the depression 15 by the exhaust flow when the engine is operating. It is possible that the portion 16 can extend outside the port 11 so that the flowing water helps keep the valve flaps open.

The invention has been described above with reference to an embodiment with two counter-rotating propellers, in which the exhaust port 11 lies co-planar with the sweep "a" of the aft propeller 5. The invention is of course also applicable to single propeller drive units where the parameters described above concerning the placement of the exhaust port relative to the aft propeller will apply to the single propeller. In general the exhaust flow should be released so that the exhaust is carried away with the propeller flow but not so that the exhaust is sucked inside the propeller sweep on the suction side of the propeller.

We claim:

1. In a boat propeller drive unit comprising a gear housing, in which at least one propeller shaft with a propeller is rotatably mounted, and an anti-cavitation plate, which extends out over the propeller from the gear housing, has a distal end located aft of the sweep of the tips of the propeller blades and contains an exhaust duct with an outlet port for exhaust from an engine coupled to the drive unit, the improvement wherein the outlet port (11) of the exhaust duct (7) opens on the underside of the cavitation plate (6) and is directed towards and is spaced (5) from the distal end of the cavitation plate, said spacing (5) being at least equal to the distance from said end to the sweep of the top of the propeller blades, and said outlet port being located so that exhaust flow lies completely outside the sweep of the propeller on a suction side of the propeller.

2. Propeller drive unit according to claim 1, wherein the cavitation plate (6) is provided on its underside with an arched hood (8), which defines the exhaust duct (7) and extends over the major portion of the length of the anti-cavitation (6).

3. Propeller drive unit according to claim 2, wherein the hood (8) is sloped in a direction from the gear housing (1) relative to surrounding planar surface portions (9) of the underside of the anti-cavitation plate (6).

4. Propeller drive unit according to claim 3, wherein the lower limitation of the hood (8) forms an angle of about 10°–15° with the planar surface portions (9) of the anti-cavitation plate (6).

5. Propeller drive unit according to claims 2, the hood (8) in horizontal projection has essentially the shape of a triangle, the point of which points towards the gear housing.

6. Propeller drive unit according to one of claim 1, wherein the dimension of the outlet port (11) transversely to the cavitation plate is substantially greater than its dimension vertically and the distance (5) from the outlet port (11) to the aft end of a surface portion (13) of the anti-cavitation plate located just above the outlet port is at least equal to twice the vertical dimension (4) of the outlet port.

7. Propeller drive unit according to one of claim 1, further including check-valve means (14) co-ordinated with the outlet port (11) to prevent water from penetrating into the exhaust duct (7) when the engine is turned off.

8. Propeller drive unit according to claim 6, wherein said surface portion (13) has a depression (15) in which a valve flap means (14), which seals the exhaust port when the engine is turned off, can be folded under the influence of the exhaust pressure when the engine is operating.

9. Propeller drive unit according to claim 1, wherein the gear housing (1) comprises with two concentrically mounted counter-rotating drivable propeller shafts (2,3) each supporting an individual propeller (4,5) and the outlet port (11) of the exhaust duct lies at least approximately co-planar with the sweep "a" of the blade tips of the aft propeller (5).

* * * * *